United States Patent [19]

Bakker nee Viel

[11] 3,996,632

[45] Dec. 14, 1976

[54] DETACHABLE COUPLING

[76] Inventor: Anna Christina Bakker née Viel, 28, van Galenlaan in Doorn, Netherlands

[22] Filed: June 17, 1975

[21] Appl. No.: 587,686

[30] Foreign Application Priority Data

June 17, 1974 France ..... 74.21954

[52] U.S. Cl. ..... 5/83; 5/86

[51] Int. Cl.[2] ..... A61G 7/10

[58] Field of Search ..... 5/81 R, 81 B, 83, 84, 5/86, 87

[56] References Cited

UNITED STATES PATENTS

| | | | |
|---|---|---|---|
| 2,793,768 | 5/1957 | Schaedler | 5/87 X |
| 3,172,551 | 3/1965 | Wolfe | 5/87 X |
| 3,659,594 | 5/1972 | Schwab | 5/87 X |
| 3,694,829 | 10/1972 | Bakker | 5/86 X |

*Primary Examiner*—Robert L. Wolfe
*Assistant Examiner*—Andrew M. Calvert
*Attorney, Agent, or Firm*—Walter Becker

[57] ABSTRACT

The coupling comprises two coupling elements, the first element of which may form part of a lifting device for lifting sick persons or invalids and the second element may serve for attaching to a supporting element to carry the sick person, the first coupling element comprising two spaced parallel jaw plates provided with first hook means adjacent their upper end and clamping means adjacent their lower end, the second coupling element comprising an elongated rod provided with second hook means adapted to cooperate with the first hook means, the said rod fitting between the jaw plates when the first and second hook means are caused to cooperate, a lower portion of the rod being provided with a cam for cooperating with the said clamping means in the coupling position.

7 Claims, 10 Drawing Figures

DETACHABLE COUPLING

The present invention relates to a detachable coupling whereby different supporting elements intended to carry a person may be coupled to and uncoupled from a device for lifting sick persons or invalids. An invalid-lifting device serves the purpose not only of moving an invalid to or from his bed, but also of performing several other operations such as weighing, taking a bath, performing restorative exercises, or placing in a swimming pool or on the seat of a toilet. Moreover, the conveying operation may be performed in several ways, since an invalid must be carried in a horizontal position in some cases or in another specific position in other cases. All these applications involve making use of supporting elements of different construction, which must nevertheless be coupled easily and safely to the lifting device.

It is an object of this invention to provide an improved detachable coupling for the above mentioned purposes.

These and other objects and advantages of the invention will appear more clearly from the following specification in connection with the accompanying drawings, in which.

The detachable coupling according to the invention is characterized primarily in that it comprises two coupling elements, the first element of which may form part of the lifting device and the second element may be attached to a supporting element. The first coupling element includes two spaced parallel jaw plates provided with first hook means adjacent their upper end and clamping means adjacent their lower end, the second couplin element comprising an elongated rod provided with second hook means adapted to cooperate with the first hook means. The said rod fits between the jaw plates when the first and second hook means are caused to cooperate, a lower portion of the rod being provided with a cam for cooperating with the said clamping means in the coupling position.

According to a preferred embodiment of the invention, the first hook means comprises notches formed in the upper extremity of the two jaw plates, while the second hook means comprises a transverse pin connected to the elongated rod, the extremities of the transverse pin projecting beyond the rod, and the clamping means comprising an adjusting screw. By inserting the transverse pin in the notches of the jaw plates and thereafter by gripping the rod between the jaw plates by means of the adjusting screw, a strong connection is obtained in an uncomplicated manner.

According to another preferred embodiment of the coupling according to the invention the cam on the elongated rod may have a recess, the first coupling element being provided with a stop against which the elongated rod may abut, whereby the recess may be positioned in alignment with the adjusting screw and the screw may be tightened with less effort.

According to still another embodiment of the invention, the first coupling element is provided with a barbed hook, the barb of which is situated in its inoperative position above an imaginary plane of the notches and within this plane, wherein when the rod is brought adjacent the notches, the barbed hook may be thrust back outside the plane of the notches against the action of a spring loading the hook. The elongated rod is thereby prevented from being displaced upwardly after the insertion of the transverse pin in the notches, since otherwise the recess would no longer have been positioned precisely in vertical alignment with the adjusting screw. Consequently, the connection is always established in the manner required, even if the operator has little experience or if the treating conditions make him nervous. The barbed hook may advantageously be formed of leaf spring material.

Figure 1:
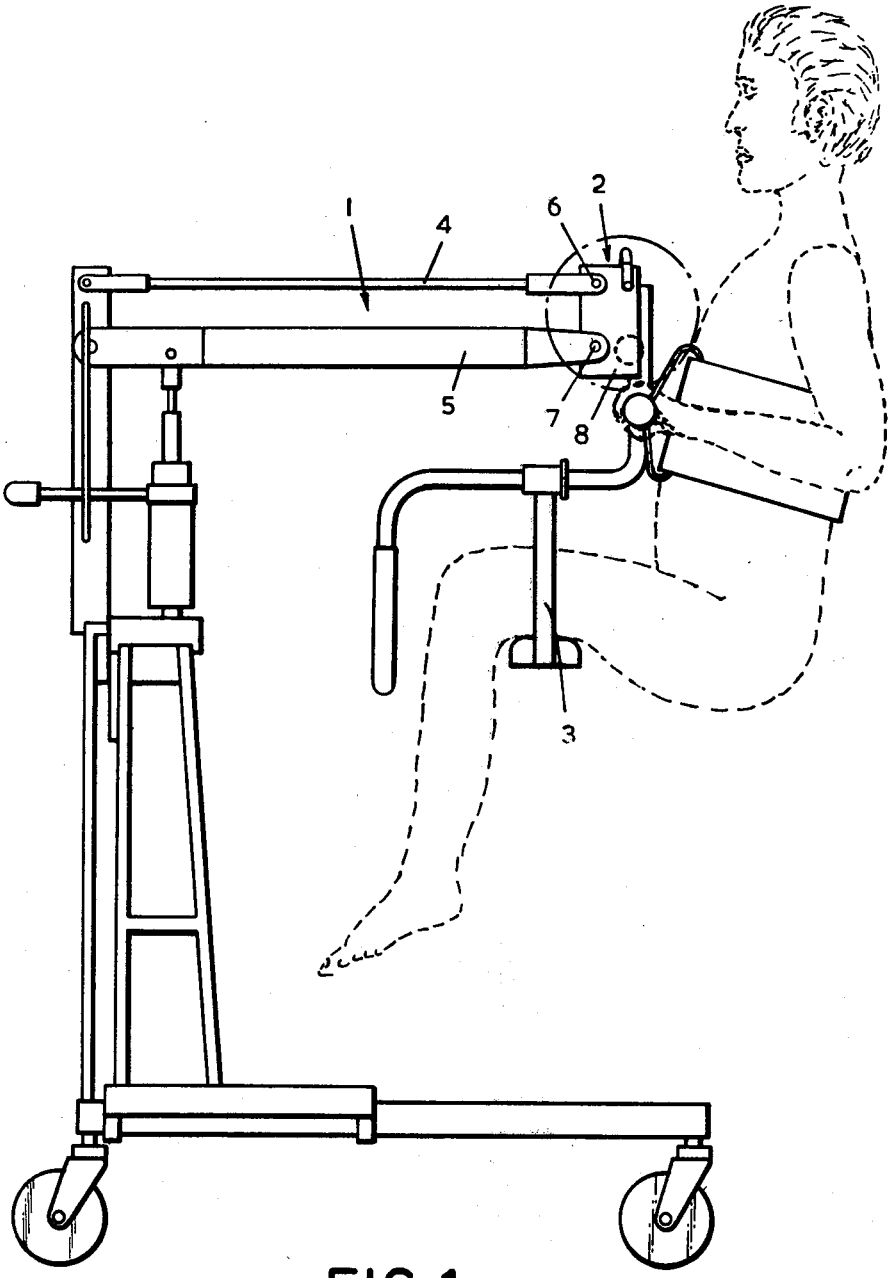
FIG. 1 is a side view of an invalid-lifting device, the lifting portion of which comprises parallel bars.

Referring now to the drawings in detail, FIG. 1 shows a device 1 for lifting patients provided with a coupling 2 of the invention to which is secured a supporting element 3 intended to carry the patient. Parallel bars 4 and 5 which comprise the lifting portion of the lifting device are pivotally coupled to a first coupling element 8 (see also FIG. 2) by means of bolts 6 and 7.

The first element 8 comprises two spaced jaw plates 9 and 10 which are rigidly interconnected by means of transverse partitions 11 and 12. The jaw plates 9 and 10 are provided with notches 13 at their upper extremity. The transverse partition 12 is provided with a barbed hook 14 made of leaf spring material and fastened to the partition 12 by means of bolts 15. The jaw plate 9 carries an adjusting screw 16 the free end 17 of which extends into the space between the two jaw plates 9 and 10. The transverse partition 11 has an abutment edge 18.

Figure 5:
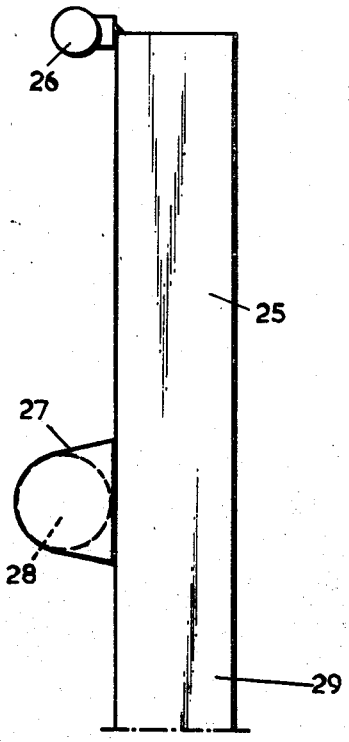
FIG. 5 is a side view of a second element according to the invention.
Figure 6:
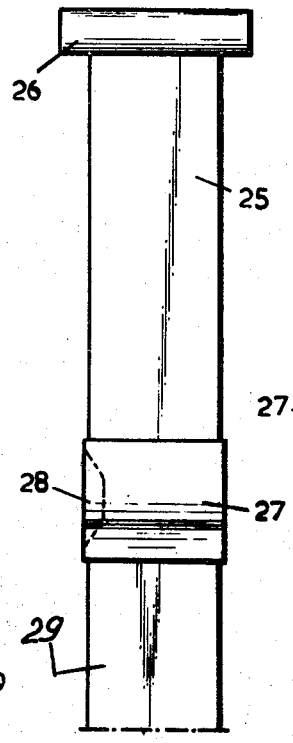
FIG. 6 is a rear view of the element of FIG. 5.
Figure 7:
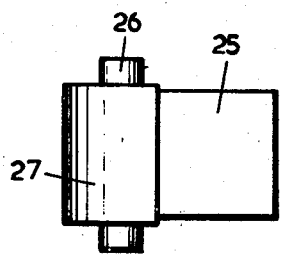
FIG. 7 is a bottom view of FIG. 5.

In FIGS. 5–7 is shown a bar 25 having such transverse dimensions as to fit between the jaw plates 9 and 10. The upper end of bar 25 has a transverse pin 26, and a cam 27 is situated on a lower portion of the bar. The lateral surface of the cam 27 has a recess 28. The lower end 29 of the bar 25 may in use be fastened to supporting elements of different construction, whereby the coupling is rendered appropriate for several applications.

Figure 2:
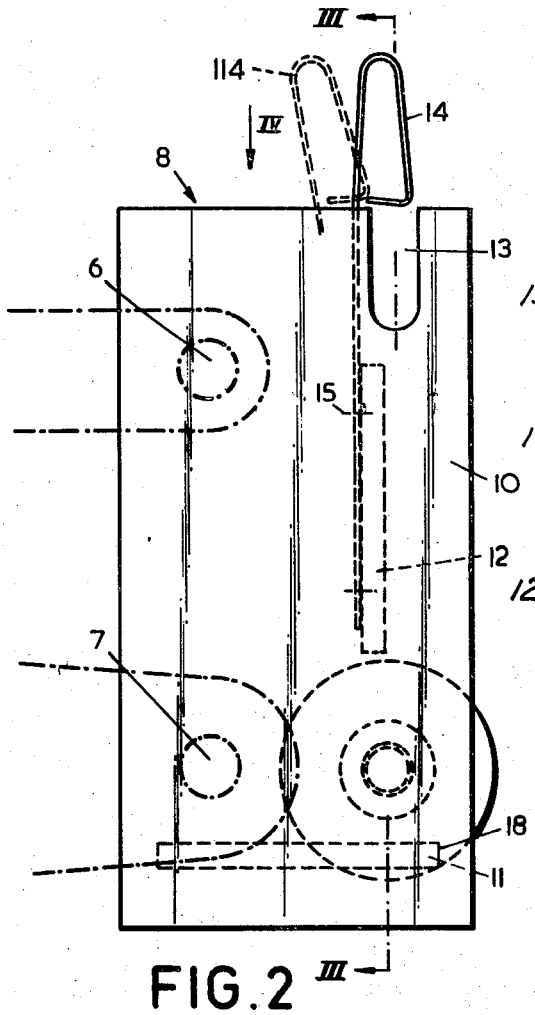
FIG. 2 is a side view of a first element of a detachable coupling in accordance with the invention, but on a larger scale than that of FIG. 1.
Figure 3:
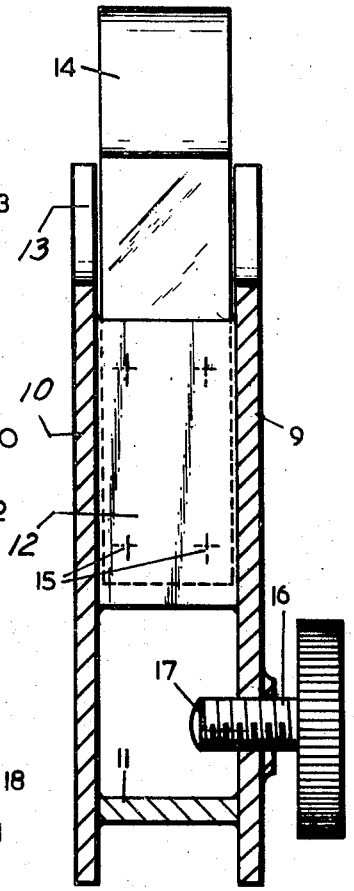
FIG. 3 is a section taken along the line III—III of FIG. 2.
Figure 4:
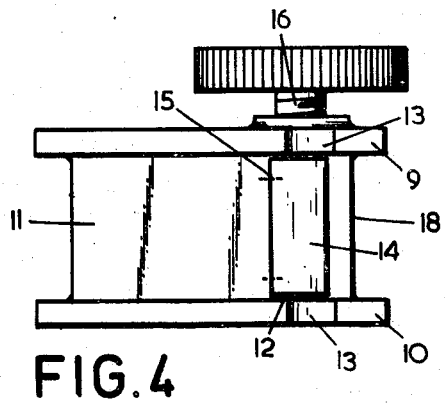
FIG. 4 is a plan view taken in the direction of the arrow IV in FIG. 2.

The coupling described above operates as follows:

The operator lifts the supporting element 3 which is provided with the second coupling element 25 shown in FIGS. 5–7 and moves it adjacent to the first coupling element 8 shown in FIGS. 2–4. The operator pushes the barbed hook 14 rearwards by means of the transverse pin 26 to the position 114 shown by broken lines in FIG. 2, whereupon the transverse pin 26 is inserted into the notches 13. The operator then causes the bar 25 to pivot with its cam 27 and thus inserts the bar 25 between the jaw plates 9 and 10 until it bears against the abutment edge 18. The adjusting screw 16 is then tightened until its end 17 is gripped in the recess 28.

It will be apparent that a particularly rigid connection between the bar 25 and the supporting element 3 is thus obtained, in the vertical direction and in all horizontal and rotational directions.

The function of the barbed hook 14 is to prevent the transverse pin 26 from disengaging from the notches 13 during the pivoting of the rod 25 between the jaw plates 9 and 10, for example following an unexpected movement by the patient.

Figure 8:
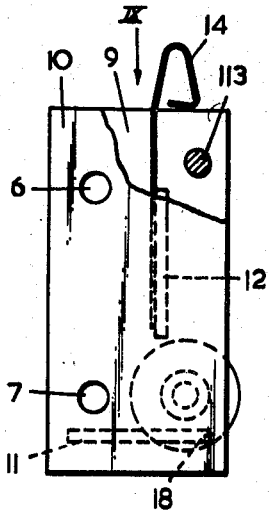
FIGS. 8–10 illustrate a modified coupling according to the invention.
Figure 10:
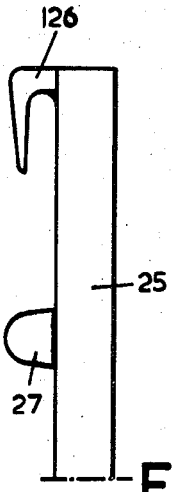
Figure 9:
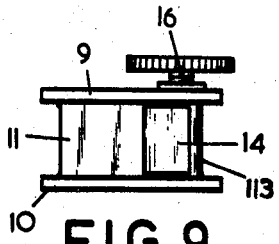

FIGS. 8–10 show a modification of coupling means. The notches in the jaw plates 9 and 10 are replaced by a rod 113 which interconnects the jaw plates, and the bar 25 is provided with a hook 126 which hooks over the rod 113, the barbed hook 14 having the same function as in the embodiment described with reference to FIGS. 2–7.

It is, of course, to be understood that the present invention is by no means limited to the specific showing in the drawings, but also comprises any modifications within the scope of the appended claims.

What I claim is:

1. In a lifting device for lifting sick persons and invalids, a detachable coupling which includes: a first coupling element for selective attachment to said lifting device, said first coupling element comprising two parallel interconnected jaw plates with hook means at their upper end and with clamping means at their lower end, a supporting element for supporting the person to be lifted, a second coupling element detachably connected to said supporting element and comprising an elongated bar with engaging means for cooperation with said hook means, said plates being so spaced from each other that said elongated bar fit therebetween when said engaging means cooperate with said hook means, and cam means arranged at the lower portion of said bar for engagement by said clamping means when said first and second coupling elements are in coupled position.

2. An arrangement according to claim 1, in which said first coupling element includes notch means located at the upper end of said two jaw plates, and in which said second coupling element includes pin means extending transverse to said elongated bar and being connected thereto while projecting beyond said bar.

3. An arrangement according to claim 1, in which said first coupling element comprises a rod interconnecting said jaw plates, and in which said second coupling element includes a hook provided on said elongated bar and operable to engage said rod.

4. An arrangement according to claim 1 in which said clamping means comprises an adjusting screw.

5. An arrangement according to claim 4, in which said cam means on the said elongated bar has a recess, and in which said first coupling element is provided with a stop against which the elongated bar may so abut that the said recess is positioned in alignment with the said adjusting screw.

6. An arrangement according to claim 1, in which said first coupling element is provided with a barbed hook of leaf spring material.

7. An arrangement according to claim 1, in which said first coupling element is provided with a spring loaded barbed hook having its barb in the inoperative position of said barbed hook located in the plane of the later, and in which said barbed hook is continuously urged into said plane, said barbed hook being movable out of said last mentioned plane by said elongated bar.

* * * * *

UNITED STATES PATENT OFFICE

CERTIFICATE OF CORRECTION

Patent No. 3669632 Dated June 13, 1972

Inventor(s) Johannes B.W. KANIJ and Arend J. NOOTHOUT

It is certified that error appears in the above-identified patent and that said Letters Patent are hereby corrected as shown below:

Add to the form:

--- Applicants claim priority Netherlands application Serial No. 6713249, filed September 29, 1967. ---

Signed and sealed this 31st day of October 1972.

(SEAL)
Attest:

EDWARD M.FLETCHER,JR.
Attesting Officer

ROBERT GOTTSCHALK
Commissioner of Patents